US005966579A

United States Patent [19]

Asai et al.

[11] Patent Number: 5,966,579

[45] Date of Patent: Oct. 12, 1999

[54] IMAGE FORMING APPARATUS HAVING A FOLDING UNIT

[75] Inventors: Hiroyuki Asai, Okazaki; Hiroharu Tanaka; Takeshi Morikawa, both of Toyokawa; Hiroyasu Ito, Okazaki, all of Japan

[73] Assignee: Minolta Co., Ltd., Osaka, Japan

[21] Appl. No.: 09/006,045

[22] Filed: Jan. 12, 1998

[30] Foreign Application Priority Data

Jan. 13, 1997 [JP] Japan ..... 9-003504

[51] Int. Cl.[6] ..... B65H 29/00; G03G 15/00

[52] U.S. Cl. ..... 399/407; 270/32

[58] Field of Search ..... 399/407, 43, 81; 270/4, 20.1, 32; 271/288

[56] References Cited

U.S. PATENT DOCUMENTS 4,592,651 6/1986 Oikawa, et al. .

5,257,081 10/1993 Kato, et al. .

5,752,154 5/1998 Maruyama et al. ..... 399/407

FOREIGN PATENT DOCUMENTS 04070772 3/1992 Japan .

05229727 9/1993 Japan .

6-156865 6/1994 Japan .

*Primary Examiner*—Arthur T. Grimley

*Assistant Examiner*—Sophia S. Chen

*Attorney, Agent, or Firm*—McDermott, Will & Emery

[57] ABSTRACT

An image forming system has a folding unit which can fold in two a sheet of paper at a position being slightly offset from the center of the sheet of paper. When an index mode is designated and a location where an index sheet is to be inserted, an index sheet which size is twice the size of a sheet of regular paper is supplied and fed to the folding unit, then is folded and fed to a tray where sheets of regular paper are stacked.

14 Claims, 10 Drawing Sheets

IMAGE FORMING APPARATUS HAVING A FOLDING UNIT

This application is based on application No. Hei 9-3504 filed in Japan, the content of which is hereby incorporated by reference.

BACKGROUND OF THE INVENTION

1. Field of the Invention

The present invention pertains to an image forming system, and more particularly to an image forming system that combines an image forming apparatus that forms an image on paper by means of the electrophotographic method and an after-processing device that folds and/or staples the paper after an image has been formed on it.

2. Description of the Related Art

In recent years, in the field of image forming apparatuses such as electrophotographic copying machines and laser printers, various types of devices termed finishers, intended to automate the processing of paper on which images have been formed, have been developed. For example, in Japanese Laid-Open Patent Application Hei 4-320896, a technology is disclosed in which a fold is made in a sheet of copy paper which is to become a cover, so that the paper that is to contain the contents of the document is inserted inside the paper that is to become the cover, and stapling is performed on the fold side of the paper.

However, using the conventional copying machine and finisher, it has been impossible to prepare a document in which one edge of a single sheet or multiple sheets protrudes from the packet of copy sheets as an index page or pages.

SUMMARY OF THE INVENTION

An object of the present invention is to solve the problem described above.

Another object of the present invention is to provide an image forming system by which a document may be automatically prepared in which one edge of an index page is made to protrude from the packet of copy sheets.

These and other objects are attained by means of an image forming system equipped with an image forming means that forms an image on a sheet of paper by means of the electrophotographic method, a paper folding means that can fold in two the paper ejected from the image forming means at a position that at least slightly offset from the center of the sheet in terms of the direction of paper feeding, a designating means that designates the position where the index page is to be inserted between the sheets on which images are formed, and a control means that performs control such that the index page is supplied and fed in accordance with a timing sequence designated by the designating means and the index page is folded in two by the folding means at a position that is somewhat offset from the center of the sheet in terms of the direction of paper feeding.

Said objects are also attained by means of an image forming system equipped with a first cassette that houses first paper, a second cassette that houses second paper, an image forming means that forms an image on the paper fed from the first or second cassette, a tray that houses the paper on which images have been formed, an instructing means that instructs the image forming system to insert the second paper into sheets of the first paper, a designating means that designates the position where the second paper is to be inserted, a feeding means that feeds second paper from the second cassette in accordance with the information regarding position designation, a folding means that folds in two the fed second paper at a position somewhat offset from the center of the sheet of said paper, and a feeding means that feeds the folded second paper to a tray.

Said objects are also attained by means of an image forming system equipped with an image forming means that forms an image on paper, a housing means that houses the paper on which images are formed, a folding means that folds in two the paper ejected from the image forming means at a position somewhat offset from the center of the sheet, a designating means that designates the position between the sheets on which images are formed at which the index page is to be inserted, and a control means that performs control such that the index page is supplied and fed in accordance with a timing sequence designated by the designating means and said index page is folded in two at a position somewhat offset from the center of the sheet in terms of the direction of paper feeding by said folding means.

Said objects are also attained by means of an sheet receiving unit equipped with a housing unit that sequentially receives sheets of paper of a first size from an image forming apparatus, a folding means that folds in two paper of a second size at a position somewhat offset from the center of the sheet, and a control means that, when paper of the second size is fed from the image forming apparatus, houses it on top of the paper of the first size in the housing unit after it is folded in two by the folding means.

BRIEF DESCRIPTION OF THE DRAWINGS

These and other objects and features of the present invention will become apparent from the following description of preferred embodiments thereof taken in,conjunction with the accompanying drawings, in which.

In the following description, like parts are designated by like reference numbers throughout the several drawings.

DETAILED DESCRIPTION OF THE PREFERRED EMBODIMENTS

Embodiments of the image forming system of the present invention are explained below with reference to the attached drawings.

(Overall Construction)

Figure 1:
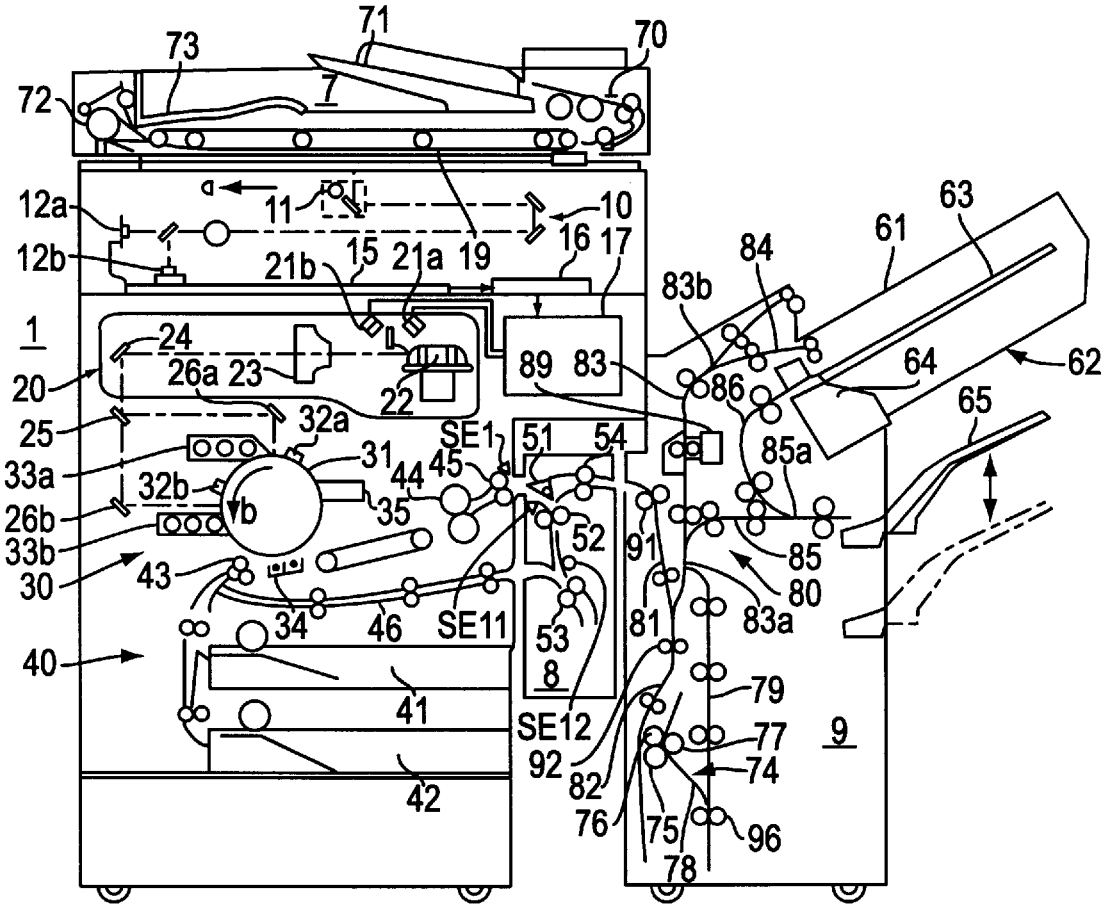
FIG.1 is a drawing showing the interior construction of the image forming system comprising one embodiment of the present invention.

As shown in FIG. 1, the image forming system comprises essentially copying machine main unit 1, automatic original document feeding device 7 mounted to the top of main unit 1, flip-over unit 8 connected to the copy paper eject unit of main unit 1, and finisher 9 that receives copy paper ejected from flip-over unit 8 and carries out after-processing such as folding and stapling.

Automatic original document feeding device 7 supplies original document housed in tray 71 one sheet at a time. It feeds or pauses the feeding of said sheets onto platen glass 19 located on main unit 1, and after their images have been read, ejects the sheets onto tray 73 via eject roller 72. This automatic original document feeding device 7 can also flip over a two-sided original document, enabling the reading of the images on both the front and back sides of the sheet. As this type of original document feeding operation is publicly known, its explanation will be omitted here.

(Construction of copying machine main unit)

Copying machine main unit 1 has original document reading unit 10 and laser optical unit 20 mounted in the upper level, image creation unit 30 mounted in the middle level, and paper supply/feeding unit 40 mounted in the lower level.

Original document reading unit 10 reads by means of CCDs 12*a* and 12*b* images on the original document placed on platen glass 19 using exposure lamp 11 and a mirror that move in the direction of arrow a, and its construction and operation are publicly known. The image signals for the images read by CCDs 12*a* and 12*b* undergo necessary processing by means of image signal processing unit 15 and memory unit 16, and are then sent to print processing unit 17. Memory unit 16 alternates between sending input image data to print processing unit 17 one page-image at a time without holding it in the memory, and holding it in memory temporarily and sending it to print processing unit 17 when necessary. Memory unit 16 also stores index data that is needed in index mode explained below. This index data is sent to print processing unit 17 in accordance with a prescribed timing sequence.

Laser optical unit 20 deflects laser beams emitted from laser diodes 21*a* and 21*b* driven by a driver inside print processing unit 17 by means of polygon mirror 22. The deflected laser beams perform scanning/exposure of photoreceptor drum 31 via f θ lens 23 and mirrors 24, 25 and 26*a* (26*b*). When this occurs, a latent electrostatic image is formed on the surface of photoreceptor drum 31. In this embodiment, laser diode 21*a* is driven by red image data, and its laser beam exposes the surface of photoreceptor drum 31 via mirror 26*a*. Laser diode 21*b* is driven by black image data, and its laser beam exposes the surface of photoreceptor drum 31 via mirror 26*b*.

Image creation unit 30 includes first photoreceptor charger 32*a*, red developer unit 33*a*, second photoreceptor charger 32*b*, black developer unit 33*b*, transfer charger 34, remaining toner cleaner 35, etc., all of which are located in the vicinity of photoreceptor drum 31 driven to rotate in the direction of arrow b. As these image creation elements are publicly known, explanations of their constructions and of the image creation process will be omitted.

Paper supply/feeding unit 40 supplies sheets of paper from either cassette 41 or cassette 42 to timing roller 43 one sheet at a time. Subsequently, the sheets are sent to a transfer position and a toner image is transferred from the surface of photoreceptor drum 31. After the transfer, toner is fused to the sheets by means of fuser unit 44 and the sheets are then sent by eject roller 45 to flip-over unit 8. In addition, paper resupply path 46 that, in order to perform two-sided copying, sends sheets that have been flipped over by means of flip-over unit 8 after copying onto one surface toward timing roller 43 once more in the manner explained below, is mounted to this paper supply/feeding unit 40.

(Flip-over unit)

Flip-over unit 8 comprises path switching claw 51, feeding roller 52, flip-over roller 53 and eject roller 54. In straight eject mode, the sheet sent by means of eject roller 45 of main unit 1 is guided along the top surface of switching claw 51 set at the position indicated by the solid line in FIG. 1 (first position) and is ejected straight ahead by eject roller 54 and sent to finisher 9.

In flip-over mode, switching claw 51 is driven to rotate somewhat in a clockwise direction (second position), and the sheet is guided by the left side surface of switching claw 51 and fed downward by feeding roller 52 and flip-over roller 53. When the trailing edge of the sheet moves past switching claw 51 (when the trailing edge of the sheet is detected by sensor SE11), switching claw 51 is driven to further rotate somewhat clockwise (third position) and feeding roller 52 and flip-over roller 53 are switched to reverse rotation. When this occurs, the sheet is guided by the right side surface of switching claw 51, flipped over and sent to finisher 9 by eject roller 54.

In paper resupply mode, sheets sent from eject roller 45 of main unit 1 are fed downward by means of feeding roller 52 and flip-over roller 53 as described above. When the trailing edge of the sheet reaches the front of flip-over roller 53 (when the trailing edge of the sheet is detected by sensor SE12), flip-over roller 53 is switched to reverse rotation When this occurs, the sheet is flipped over and sent to paper resupply path 46.

(Finisher)

Finisher 9 comprises non-sort tray 61 that accumulates and houses sheets sent from flip-over unit 8, stapling unit 62 that sends sheets from tray 63 after they have been accumulated in tray 63 and binds them by means of stapler 64, large-capacity holding tray 65 that can move up and down, folding unit 74 and paper feeder 80.

Feeder 80 comprises feeding path 81 that receives by means of roller 91 the sheets sent from flip-over unit 8 and feeds them downward, switchback feeding path 82 that reverses the direction of the sheets by means of roller 92 and feeds them upward, feeding path 83 that feeds the switched-back sheets to non-sort tray 61, feeding path 84 that feeds sheets from diverging point 83*b* of feeding path 83 to stapling tray 63, feeding path 85 that feeds sheets from diverging point 83*a* of feeding path 83 to large-capacity holding tray 65, and feeding path 86 that feeds packets of sheets that have been bound by means of stapler 64 to confluence point 85*a* of feeding path 85. In addition, punch hole opening unit 89 is located in feeding path 83.

Figure 3A:
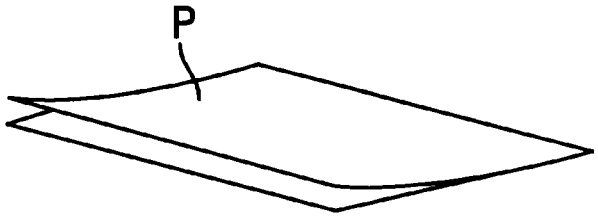
FIGS. 3(A), 3(B), 3(C) and 3(D) explanatory drawings showing the various configurations used in the folding process.
Figure 3B:
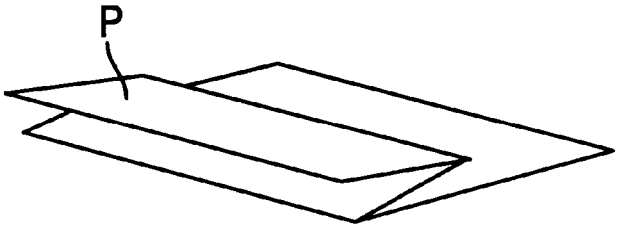
Figure 3C:
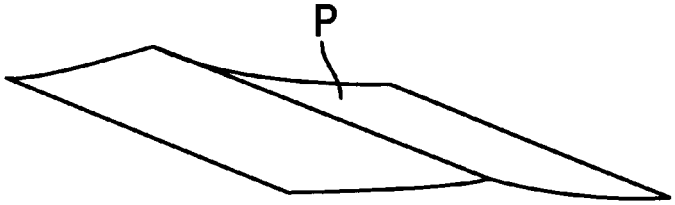

Folding unit 74 comprises three folding rollers 75 through 77. As shown in FIGS. 3(A) through 3(C), sheet P can be processed in center fold mode in which it is folded in two in the center, in Z-fold mode in which it is folded into a Z-shaped configuration, and in open mode in which folded sheet P may be opened so that the packet of sheets may be bound like a magazine. As these types of folding processing performed by means of the three folding rollers 75 through 77 are publicly known, their explanations will be omitted here. The folded sheets are fed downward from feeding path 78 to vertical feeding path 79, and are then switched back by roller 96, and fed upward through vertical feeding path 79 to diverging point 83*a* of feeding path 83.

Figure 3D:
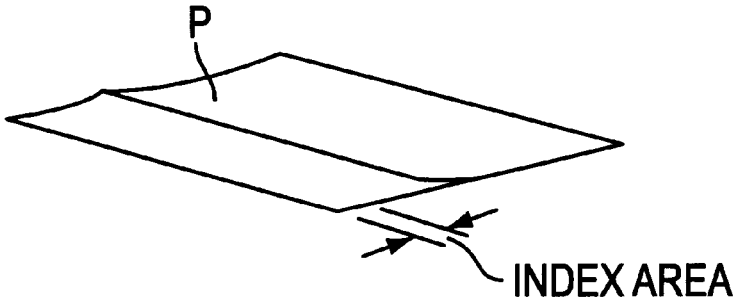
Figure 4A:
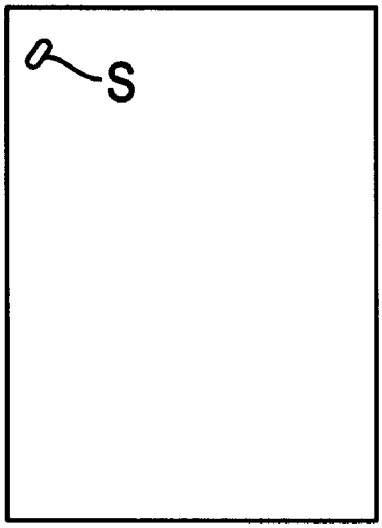
FIGS. 4(A), 4(B) and 4(C) are explanatory drawings showing the various configurations used in the stapling process.
Figure 4B:
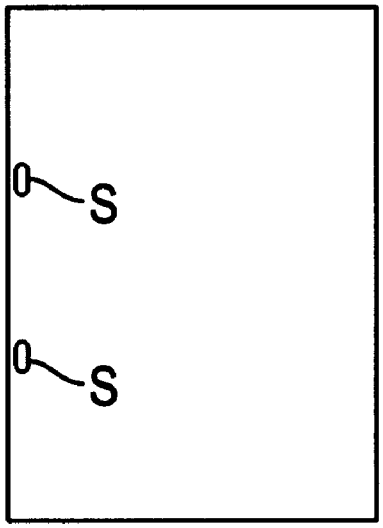
Figure 4C:
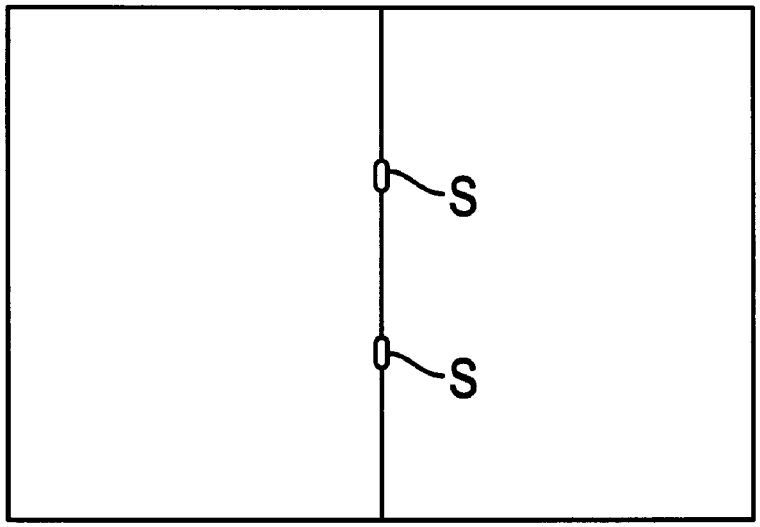

In addition, in this embodiment, as shown in FIG. 3(D), sheet (index page) P may be processed in index fold mode such that it is folded in two at a position somewhat offset from the center. When the sheet is folded this way, one of the fold sections of index page P is somewhat larger than the other. The area of the larger portion that is larger than half the size of the index page is called the index area. When this index page P is subsequently housed in tray 63, the index area protrudes from the edges of the other sheets that are stored in tray 63 in the same fashion.

Figure 2:
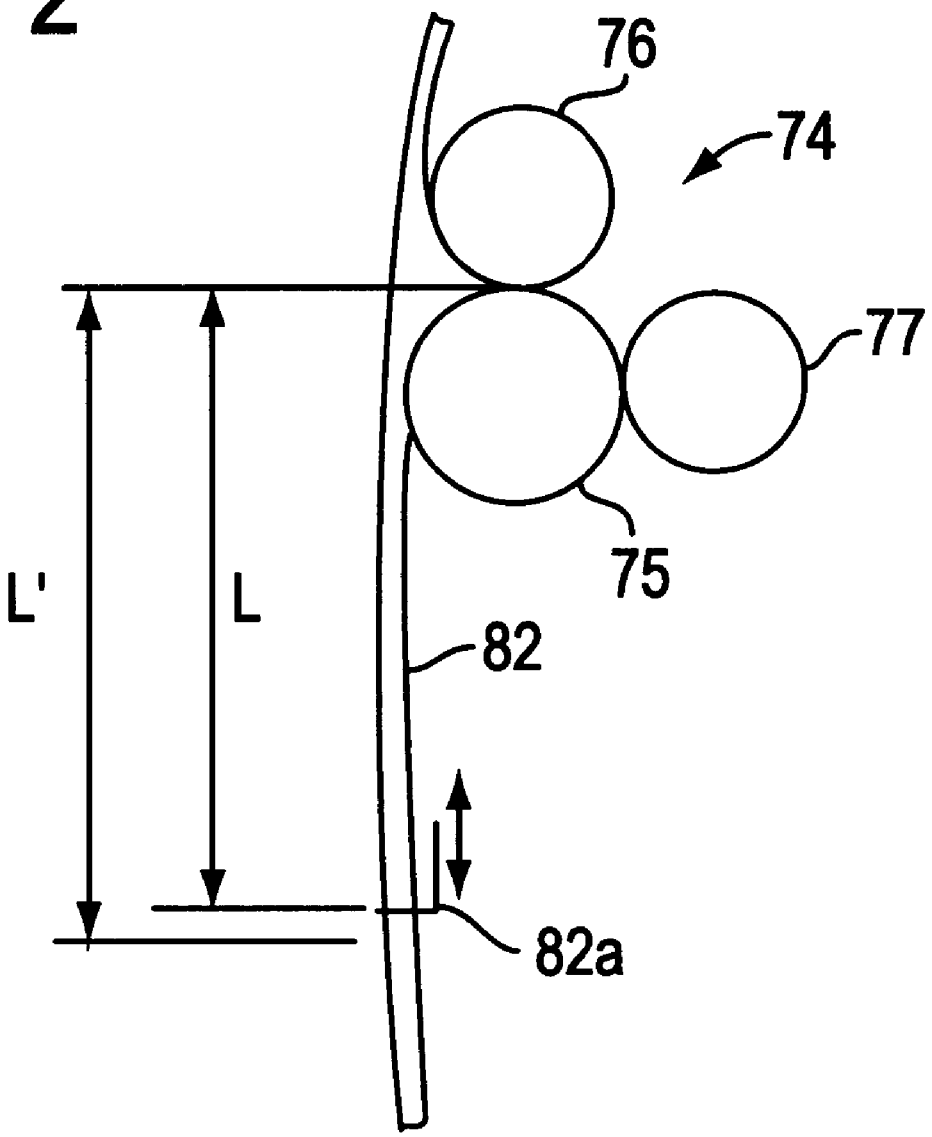
FIG. 2 is a drawing showing the important parts of the folding unit.

Incidentally, as shown in FIG. 2, index fold processing is performed by changing the position of stopper 82*a* that comes into contact with the leading edge of the sheet fed downward via feeding path 82. In other words, in regular folding, stopper 82*a* is set at a position that is distance L from the nipping area of folding rollers 75 and 76 such that the center of the sheet will be grasped by said rollers 75 and 76. During index fold processing, by setting stopper 82*a* at a position that is distance L' from the nipping area of the rollers, which distance is somewhat longer than distance L, the sheet will be folded in two at a position that is somewhat offset from the center and the index area will be formed.

Packets of paper that have accumulated in accumulating tray 63 can be stapled by stapling unit 62 via corner staple mode in which staple S is inserted in the corner area, side staple mode in which staples S are inserted in one side, and center staple mode in which staples S are inserted along the fold. As these types of stapling are publicly known, their explanations will be omitted here.

(Operation panel)

Figure 5:
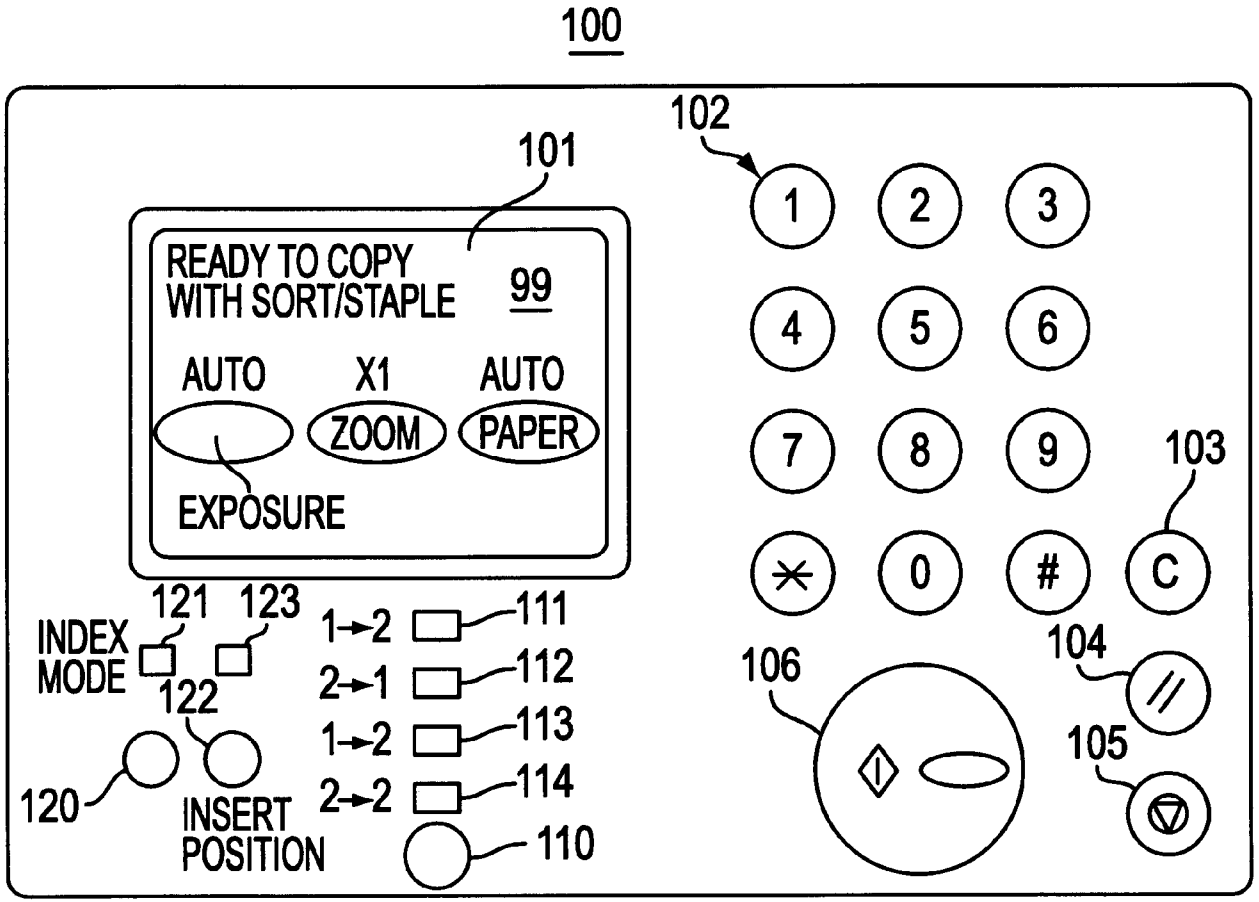
FIG. 5 is a plan view of the operation panel of the image forming system.

FIG. 5 shows operation panel 100 located on copying machine main unit 1. On this operation panel 100 are located liquid crystal touch panel 101, numeric keypad 102 to input the number of copies and the copy magnification, clear key 103 to reset the input information via numeric keypad 102, reset key 104 to reset the various copy modes back to the initial setting, stop key 105 to stop the copy operation, and start key 106 to start the copy operation. In addition, copy mode selection key 110 to set the copy mode when the copying machine is combined with the automatic original document feeding device 7, index mode selection key 120 and insert position designation key 122 are also located on operation panel 100. The copy mode is initially set to "ONE-ONE" (one-sided original, one-sided copy) mode, in which case LED 111 is illuminated. The subsequent pressing of copy mode selection key 110 causes the copy mode to cycle sequentially among "BOTH-ONE" mode (two-sided original, one-sided copy), "ONE-BOTH" mode (one-sided original, two-sided copy), and "BOTH-BOTH" mode (two-sided original, two-sided copy), in which cases the corresponding LED 112, LED 113, or LED 114, respectively, is illuminated.

Index mode is not selected as an initial setting, and LED 121 is not illuminated. Each time index mode selection key 120 is pressed, index mode alternates between "selected" and "not selected", and where it is selected, LED 121 is illuminated. In addition, each time insert position designation key 122 is pressed, the insert position designation function alternates between designation possible and designation impossible. When insert position designation is possible, LED 123 is illuminated and it is possible to designate the position at which to insert the index page between the copy sheets. Designation is performed by inputting via numeric keypad 102 the number of pages of the original document that occur immediately before the index page is to be inserted. Automatic original document feeder 7 has a function to count the number of original pages supplied from tray 71, and when the count value matches the designated value, the next page, i.e., the index page, is supplied from either cassette 41 or cassette 42. Index mode will be further described in detail below.

(Control circuit)

Figure 6:
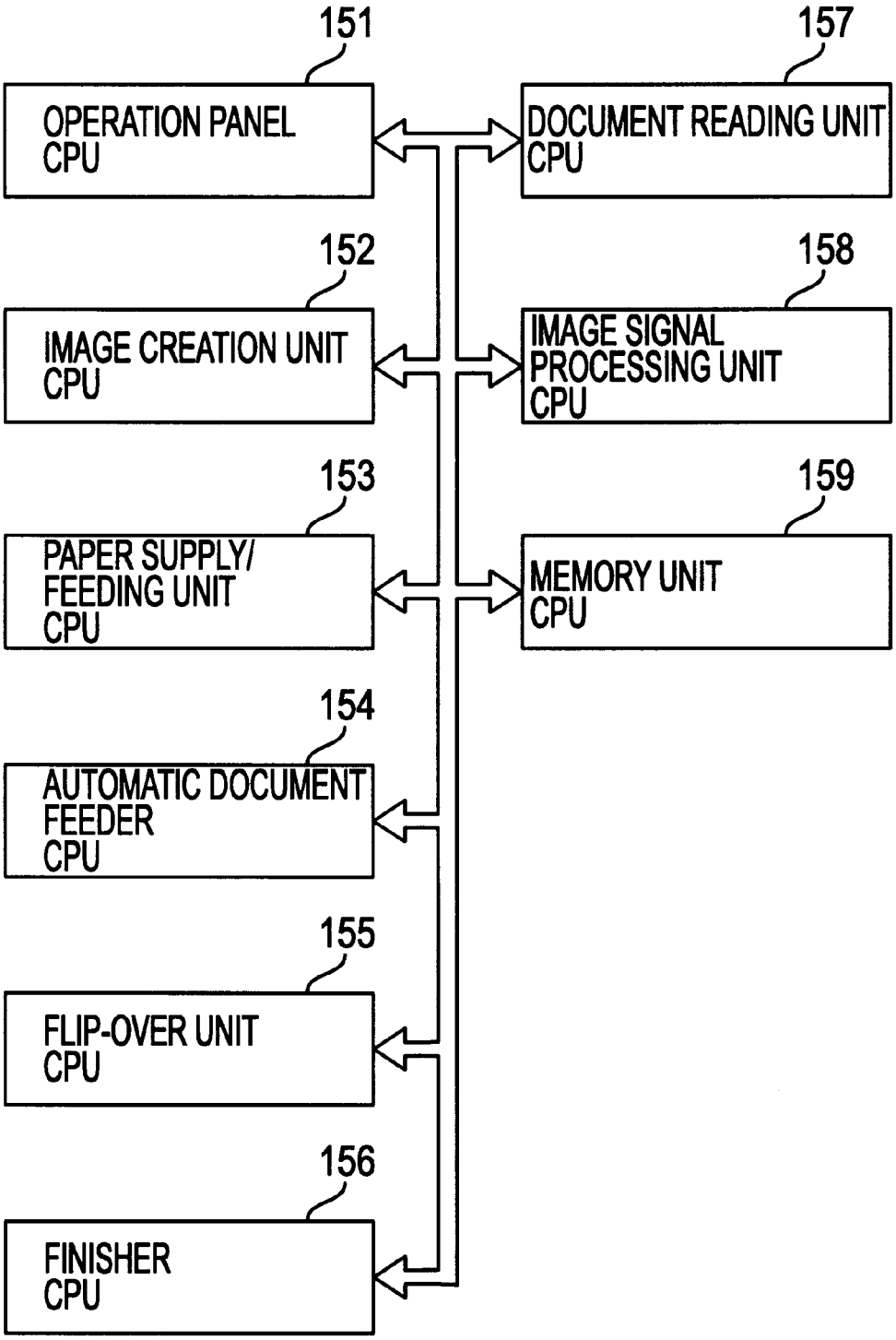
FIG. 6 is a block diagram showing the control circuit.

FIG. 6 shows CPUs 151 through 159 to control the operation of the image forming system. These CPUs 151 through 159 contain either ROM that houses necessary programs or RAM that houses parameters for the execution of programs.

CPU 151 controls the input signals from the various keys on operation panel 100 as well as display signals. CPU 152 controls image creation unit 30, laser optical unit 20 and print processing unit 17. CPU 153 controls paper supply/feeding unit 40. CPU 154 controls automatic original document feeder 7, CPU 155 controls flip-over unit 8, and CPU 156 controls finisher 9. CPU 157 controls original document reading unit 10, CPU 158 controls image signal processing unit 15, and CPU 159 controls memory unit 16. These CPUs 151 through 159 exchange signals while performing necessary processes.

(Index mode, first embodiment)

Where index mode is selected by means of key 120, designation of the index page insert position is performed by operating numeric keypad 102 after key 122 is pressed. For example, where the paper is A4 size paper, the index page is automatically selected to be A3 size paper. After image formation, the index page passes straight through flip-over unit 8 and is then housed in accumulating tray 63 by means of paper feeder 80 of finisher 9 with the image formation side down. In other words, the sheet is sent from feeding path 81 to feeding path 82, and is then switched back immediately after passing roller 92 to be sent to feeding path 83. It is finally housed in tray 63 after being fed from diverging point 83*b* via feeding path 84.

If it is the index page insert position, the A3 size index page is supplied. Index data input beforehand to memory unit 16 is printed at the trailing edge of this index page in terms of the direction of paper feeding. The index page is then sent to flip-over unit 8, where it is flipped over by means of feeding roller 52 and flip-over roller 53 immediately after passing switching claw 51, and is then sent to finisher 9 by means of eject roller 54. The index page is then sent from feeding path 81 to folding unit 74, and folded in two once in index fold mode (FIG. 3(D)) by means of folding rollers 75 and 76. The index page is then sent downward from feeding path 78 via vertical feeding path 79 with the fold area first, and sent upward in vertical feeding path 79 after being switched back by roller 96. It is then sent from diverging point 83*b* to feeding path 83, and is finally housed in accumulating tray 63 via diverging point 83*b* and feeding path 84.

In this first embodiment, it is not necessarily essential for the index data to be printed on the index page. It is also acceptable if the index area is left blank such that the user can write in the desired index after finishing is completed.

(Index mode, second embodiment)

In the second embodiment, index page insert position designation is performed by inserting an index original inside the multi-page original document. As the index original, a sheet of a different type from the regular original document may be used, such as a sheet of a different size, or in which a notch is formed at a prescribed location, or in which the background is of a prescribed color. When this sheet is sent from tray 71, sensor 70 detects that this is the index page insert position. When this occurs, either the index page is supplied and the index data is printed, or the index image previously formed on the index original is copied. The operations to send the index page to finisher 9 via flip-over unit 8, fold it in two and house it in accumulating tray 63 are identical to those in the first embodiment.

(Control processes)

Next, the important parts of the control sequence used in index mode are explained with reference to the flow charts in FIGS. 7 through 10. The control sequence explained below pertain to the index mode used in the first embodiment. In the explanations below, 'on-edge' refers to the changing of sensors or keys from the OFF state to the ON state, and 'off-edge' refers to the changing of sensors or keys from the ON state to the OFF state.

Figure 7:
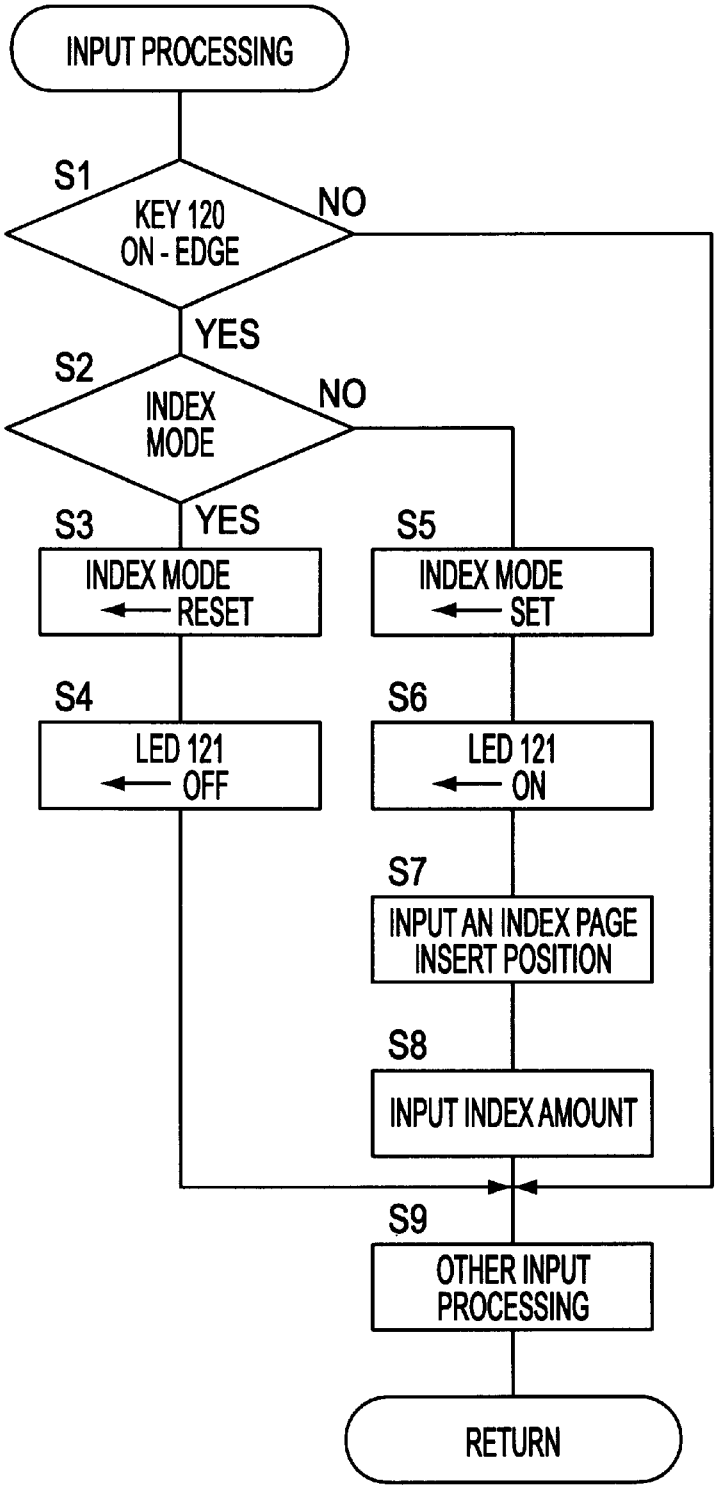
FIG. 7 is a flow chart showing the control sequence for input processing.

FIG. 7 shows the input processing subroutine performed by CPU 151. First, it is determined in step S1 whether or not index mode selection key 120 is 'on-edge'. If key 120 is 'on-edge', it is determined in step S2 whether or not the index mode is currently set. If the index mode is currently in the set state, the index mode is reset in step S3, LED 121 is turned OFF in step S4, and the subroutine advances to step S9. On the other hand, if the index mode is currently in the reset state, the index mode is set in step S5 and LED 121 is turned ON in step S6.

Next, the index page insert position is input in step S7 using numeric keypad 102, and the index amount is input in step S8. The index amount refers to the width dimension of the index area shown in FIG. 3(D), and is set beforehand at a value that corresponds to the paper size. This index amount is set by adjusting the position of stopper 82*a* shown in FIG. 2. Other input processing is then performed in step S9.

Figure 8:
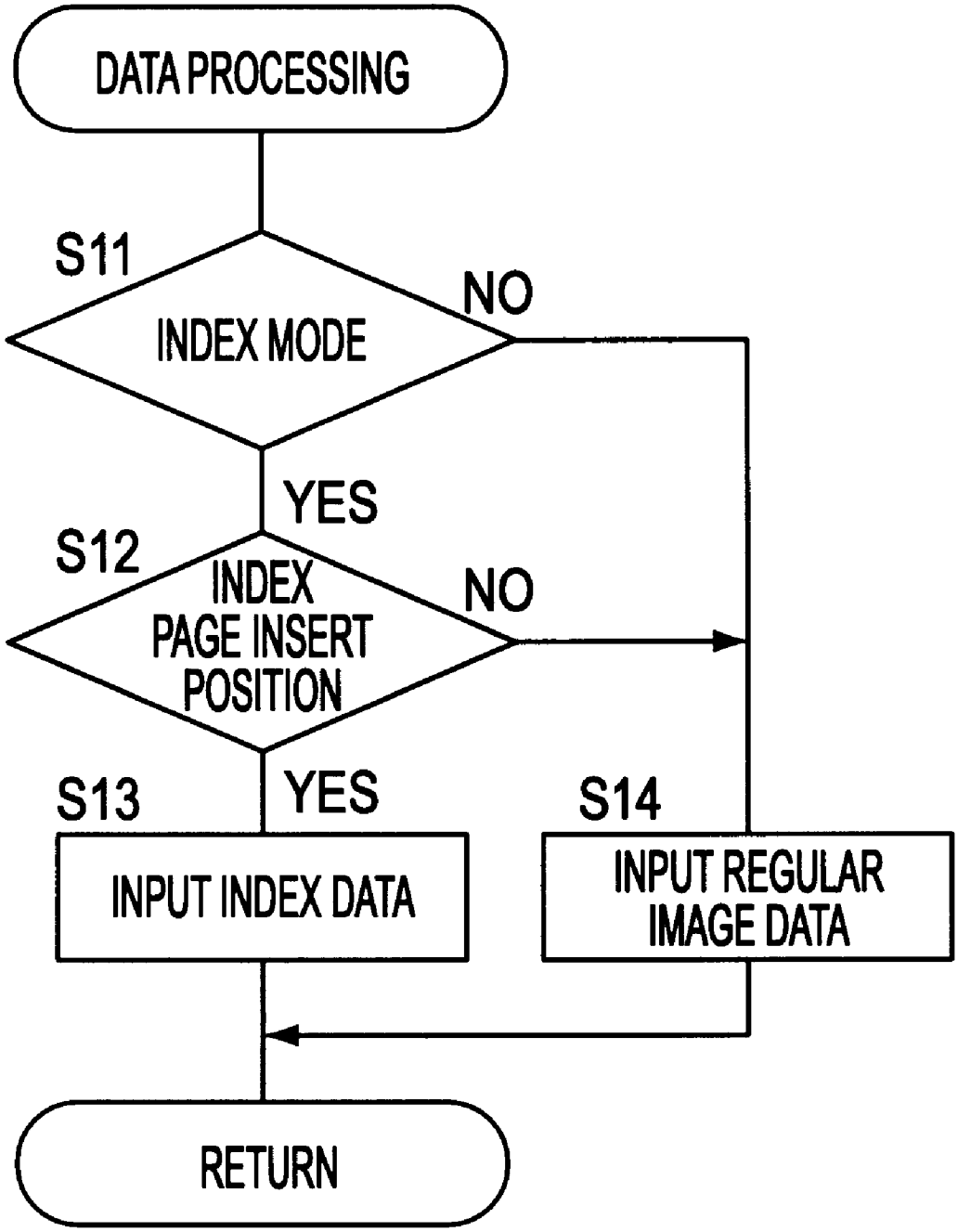
FIG. 8 is a flow chart showing the control sequence for data processing.

FIG. 8 shows the data processing subroutine performed by CPU 159. First, it is determined in step S11 whether or not index mode is active, and if index mode is not active, memory unit 16 sends regular image data (for an original document image read by original document reading unit 10) to print processing unit 17. If index mode is active, it is determined in step S12 whether or not it is the index page insert position. If it is not the index page insert position, regular image data is sent to print processing unit 17 in step S14. In this case, memory unit 16 outputs the image data for the original document set on platen glass 19. On the other hand, if it is the index page insert position, memory unit 16 outputs the index data in step S13. In this case, an index page is supplied from either cassette 41 or cassette 42 and the index data is printed on the index page.

Figure 9:
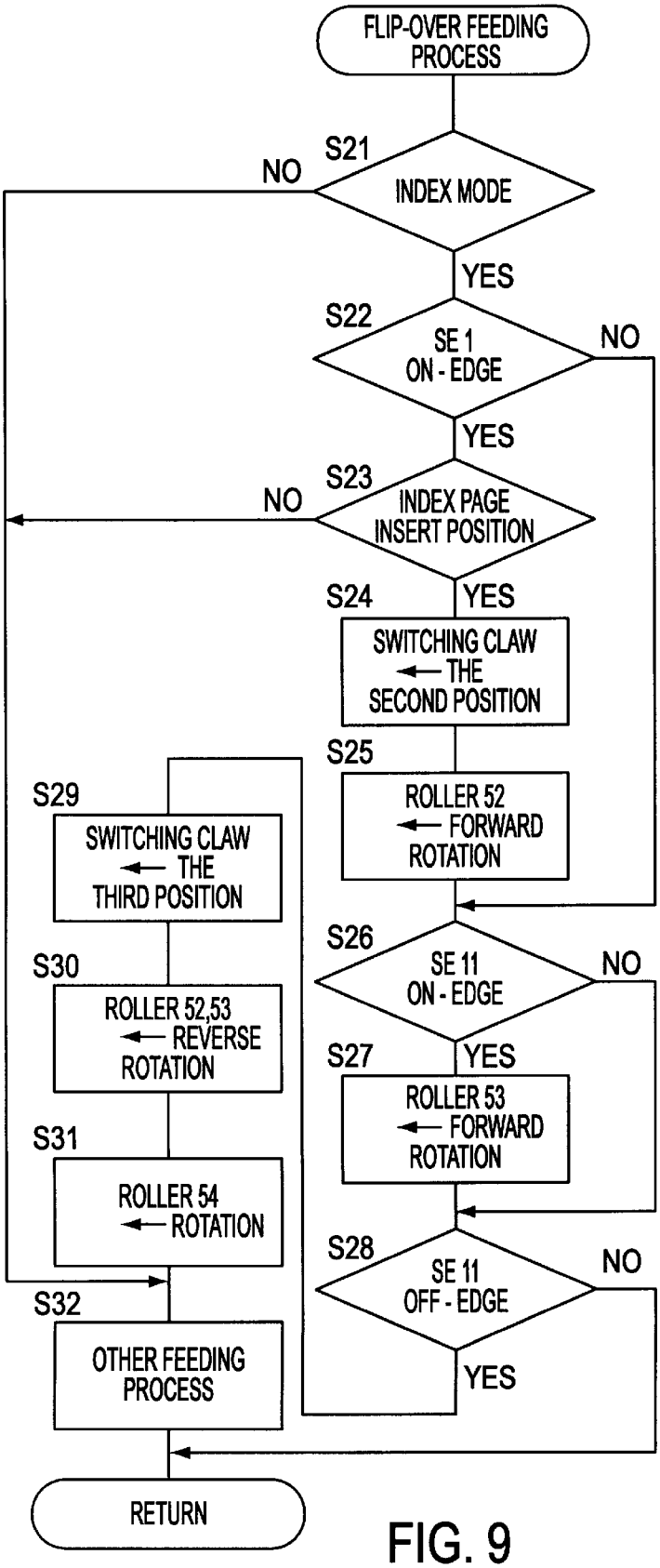
FIG. 9 is a flow chart showing the control sequence for flip-over feeding.

FIG. 9 shows the flip-over feeding subroutine for flip-over unit 8 performed by CPU 155. First, it is determined in step S21 whether or not index mode is active, and if index mode is not active, the feeding processes of other copy modes are performed in step S32. If index mode is active, it is determined in step S22 whether or not eject sensor SE1 of copying machine main unit 1 is 'on-edge'. When it is 'on-edge', i.e., when the leading edge of the sheet has reached eject roller 45, it is determined in step S23 whether or not it is the index page insert position. If it is the index page insert position, switching claw 51 is set at the second position in step S24 in order to flip over the index page, and feeding roller 52 is rotated forward in step S25. When this occurs, the index page is fed downward inside flip-over unit 8.

Next, when it is confirmed in step S26 that sensor SE11 is 'on-edge', in other words, when the leading edge of the index page reaches the front of flip-over roller 53, flip-over roller 53 is rotated forward in step S27. When this occurs, the leading edge of the index page is fed into flip-over unit 8 by means of flip-over roller 53. When it is then confirmed in step S28 that sensor SE11 is 'off-edge', i.e., when the trailing edge of the index page has reached the detection point of sensor SE11, switching claw 51 is set at the third position in step S29, feeding roller 52 and flip-over roller 53 are switched to reverse rotation in step S30, and eject roller 54 is simultaneously rotated in step S31. When this occurs, the index page is flipped over and sent on to finisher 9.

On the other hand, if it is determined in step S23 that it is not the index page insert position, the feeding process of regular copy mode is performed in step S32.

Figure 10:
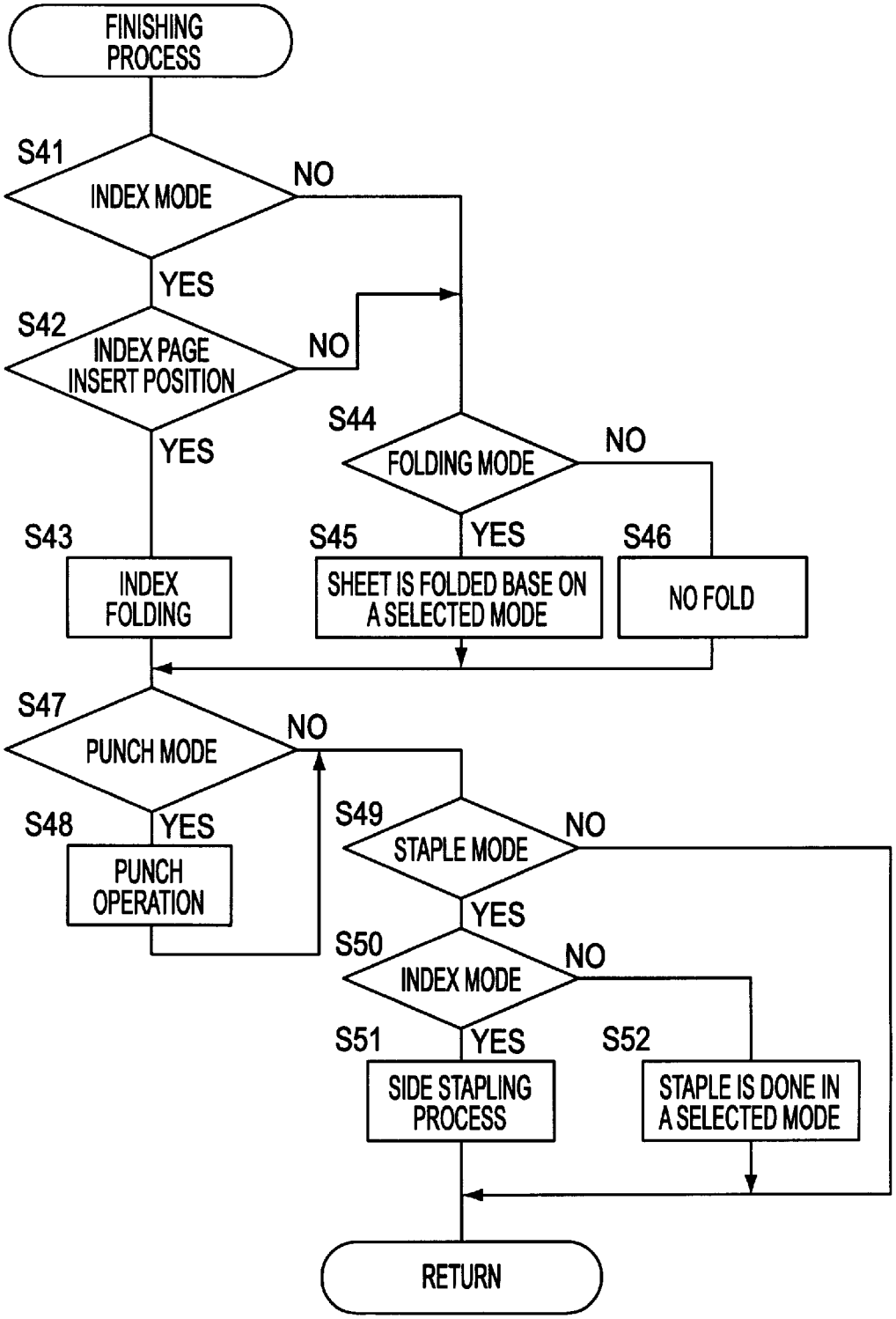
FIG. 10 is a flow chart showing the control sequence for finishing.

FIG. 10 shows the finishing process subroutine performed by CPU 156. First, it is determined in step S41 whether or not index mode is active, and if it is, it is determined in step S42 whether or not it is the index page insert position. If it is the index page insert position, the index page is fed to folding unit 74 which then performs index folding to it in step S43, and it is then fed to stapling unit 62. If the answer is NO in either step S41 or S42, it is determined in step S44 whether or not a folding mode has been selected, and if the answer is YES, the copy sheets are processed in accordance with the selected folding mode in step S45. If a folding mode has not been selected, the copy sheets are conveyed to either tray 61, tray 63 or tray 65 in step S46 without being folded.

Next, after confirming in step S47 that punch mode has been selected, punch holes are formed in the sheets via the operation of punch unit 89 in step S48.

It is then determined in step S49 whether or not staple mode is active, and in step S50 whether or not index mode is active. If the answer to both of these inquiries is YES, side stapling is performed in step S51. If index mode is not active, the packet of copy sheets is stapled in accordance with the staple mode selected in step S52.

Usually, the paper used for the index page is twice the size of a regular page, but the invention is not limited to this.

Furthermore, the image forming system of the present invention is not limited to the embodiments described above, and various changes may be made within their essential scope.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming system, comprising:

image forming means for forming an image on a sheet;

folding means for folding in two a sheet at a position being slightly offset from the center of the sheet;

designating means for designating a location where an index sheet is to be inserted between sheets ejected from the image forming means;

feeding means for feeding an index sheet to the folding means; and control means for controlling the folding means and feeding means so that the index sheet is fed to the folding means in accordance with a timing designated by the designating means and the index sheet is folded in two by the folding means at the position being slightly offset from the center of the sheet.

2. An image forming system according to claim 1, wherein said image forming means forms an image on a sheet by means of an electrophotographic method.

3. An image forming system according to claim 1, wherein said image forming means forms an index image on the index sheet before said index sheet is folded.

4. A sheet receiving unit, comprising:

a tray which receives sheets of a first size from an image forming device;

a sheet folder which folds in two a sheet at a position being slightly offset from the center of the sheet; and a feeder which feeds a sheet of a second size to said sheet folder and feeds the folded sheet by said sheet folder on the sheet of a first size stacked in said tray.

5. A sheet receiving unit according to claim 4, wherein said second size is twice the first size.

6. An image forming system, comprising:

an image forming means for forming an image on a sheet;

accommodating means for accommodating sheets on which images have been formed by said image forming means;

designating means for designating an insertion of an index sheet;

folding means for folding in two the index sheet, which is fed based on a designation by said designating means, at a position being slightly offset from the center of the index sheet; and feeding means for feeding the folded index sheet to said accommodating means.

7. An image forming system according to claim 6, wherein said image forming means forms an index image on the index sheet before said index sheet is folded.

8. An image forming system according to claim 6, wherein said index sheet is twice the size of the sheet which is not folded.

9. An image forming apparatus, comprising:

a first cassette that houses first sheets;

a second cassette that houses second sheets;

image forming means for forming an image on a sheet fed from the first or second cassette;

a tray that houses sheets on which an image has been formed;

instructing means for instructing an insertion of one of the second sheets into the first sheets in said tray and a location where the one of the second sheets is to be inserted;

supplying means for supplying the one of the second sheets from the second cassette in accordance with the location instructed by said instructing means;

folding means for folding in two the one of the supplied second sheets at a position slightly offset from the center of the sheet; and feeding means for feeding the folded one of the second sheets to said tray.

10. An image forming apparatus according to claim 9, wherein said image forming means forms an index image on one of the supplied second sheets before it is folded.

11. An image forming apparatus according to claim 10, wherein said image forming means forms the index image on one of supplied second sheets based on image information stored in a memory.

12. An image forming apparatus according to claim 9, wherein said instructing means includes an operation panel having numeric keys for inputting the location where one of the second sheets is to be inserted.

13. An image forming apparatus according to claim 9, further comprising:

image reading means for reading an image on an original document at a reading station; and document feeding means for feeding an original document to the reading station, and wherein said instructing means instructs the location based on an index document which is inserted in original documents to be fed by said document feeding means.

14. An image forming apparatus according to claim 9, wherein the size of one of said second sheets is twice the size of one of said first sheets.

* * * * *